US006671477B2

(12) United States Patent
Komatsu et al.

(10) Patent No.: US 6,671,477 B2
(45) Date of Patent: Dec. 30, 2003

(54) DEVELOPING DEVICE, PROCESS CARTRIDGE AND IMAGE FORMING APPARATUS

(75) Inventors: Noriyuki Komatsu, Shizuoka (JP); Toru Oguma, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/093,741

(22) Filed: Mar. 11, 2002

(65) Prior Publication Data

US 2003/0068172 A1 Apr. 10, 2003

(30) Foreign Application Priority Data

Oct. 10, 2001 (JP) ..... 2001-313027

(51) Int. Cl.[7] ..... G03G 15/08; G03G 21/18
(52) U.S. Cl. ..... 399/113; 399/119
(58) Field of Search ..... 399/119, 222, 399/228, 234, 252, 265, 279, 111, 113

(56) References Cited

U.S. PATENT DOCUMENTS 4,894,684 A 1/1990 Nakajima et al.
5,369,475 A * 11/1994 Kashiwagi ..... 399/119
5,455,665 A 10/1995 Baba et al.
5,768,658 A 6/1998 Watanabe et al. ..... 399/111
5,790,923 A 8/1998 Oguma et al. ..... 399/106
5,812,909 A 9/1998 Oguma et al. ..... 399/103
6,097,909 A 8/2000 Watanabe et al. ..... 399/111
6,144,821 A 11/2000 Oguma et al. ..... 399/114
6,266,500 B1 7/2001 Numagami et al. ..... 399/104
6,272,299 B1 8/2001 Numagami et al. ..... 399/111
6,377,759 B1 4/2002 Abe et al. ..... 399/27
6,385,416 B1 * 5/2002 Horikawa et al. ..... 399/111

FOREIGN PATENT DOCUMENTS

EP 1 081 560 3/2001

OTHER PUBLICATIONS

European Search Report.

* cited by examiner

*Primary Examiner*—William J. Royer
(74) *Attorney, Agent, or Firm*—Fitzpatrick, Cella, Harper & Scinto

(57) ABSTRACT

A developing device has a developing roller for developing an electrostatic latent image formed on an image bearing member, a developer containing portion for containing therein a developer to be supplied to the developing roller, a first frame for supporting the developing roller, a second frame for movably supporting the first frame, and supporting the developer containing portion, and an urging member for urging the developing roller toward the image bearing member.

20 Claims, 12 Drawing Sheets

DEVELOPING DEVICE, PROCESS CARTRIDGE AND IMAGE FORMING APPARATUS

BACKGROUND OF THE INVENTION

1. Field of the Invention

The invention relates to a developing device for use in an image forming apparatus of the electrophotographic type, a process cartridge having the same, and an image forming apparatus having the process cartridge.

2. Description of Related Art

The construction of a process cartridge using a developing device according to the conventional art will be described below. In a photosensitive member unit of the process cartridge, there are disposed a photosensitive drum which is an image bearing member on which an electrostatic latent image is formed, charging means for uniformly charging the surface of a photoconductive layer of the photosensitive drum, and cleaning means for scraping off any residual toner not transferred to a recording medium but adhering to the photosensitive drum, and storing the scraped-off toner in a waste toner container.

Also, in a developing unit, there are disposed a toner container containing a toner therein, a developing roller for supplying the toner to the electrostatic latent image formed on the photosensitive drum and forming a visible image, a developing blade for giving triboelectrification charges to the toner and forming a toner layer on the surface of the developing roller, and a jet preventing sheet for preventing the leakage of the toner in the radial direction of the developing roller. The developing unit and the photosensitive member unit are rotatably connected together by an engagement pin. The engagement pin is provided at a location at which the developing roller supported by the developing unit and the photosensitive member supported by the photosensitive drum unit are movable. A biasing spring is provided between the developing unit and the photosensitive member unit so as to urge the developing roller toward the photosensitive drum.

In the above-described developing unit according to the conventional art, however, the developing unit and the photosensitive member unit are rotatably connected and therefore, the weight of the toner in the toner container is added to the pressure force urging the developing roller toward the photosensitive drum. Consequently, the pressure force pressing the developing roller toward the photosensitive drum fluctuates due to the consumption of the toner during image formation. The driving torque of the developing unit also fluctuates with the fluctuation of the pressure force.

SUMMARY OF THE INVENTION

It is an object of the present invention to provide a developing device in which the pressure force of a developing roller toward an image bearing member can be stabilized, a process cartridge having the developing device, and an image forming apparatus having the process cartridge.

It is another object of the present invention to provide a developing device in which the pressure force of a developing roller toward an image bearing member can be stabilized independently of the amount of developer in a developer containing portion, a process cartridge having the developing device, and an image forming apparatus having the process cartridge.

It is another object of the present invention to provide a developing device in which the pressure force of a developing roller toward an image bearing member can be stabilized and at the same time, an improvement in the assembling property has been realized, a process cartridge having the developing device, and an image forming apparatus having the process cartridge.

It is another object of the present invention to provide a developing device having:

- a developing roller for developing an electrostatic latent image formed on an image bearing drum;
- a developer containing portion for containing therein a developer to be supplied to the developing roller;
- a first frame for supporting the developing roller;
- a second frame for movably supporting the first frame, and supporting the developer containing portion; and
- an urging member for urging the developing roller toward the image bearing drum,
- a process cartridge having the developing device, and an image forming apparatus having the process cartridge.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 12:
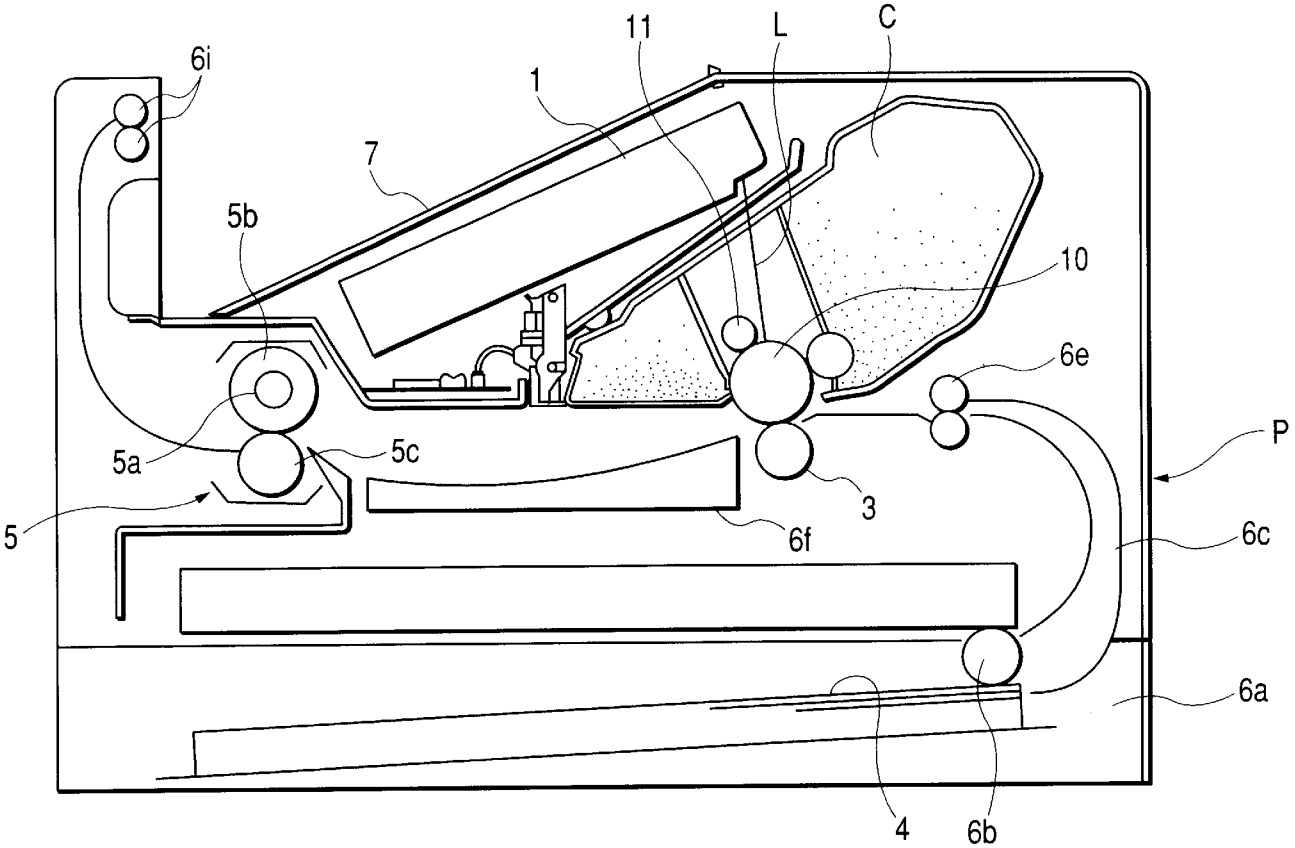
FIG. 12 shows the general construction of an image forming apparatus according to the present embodiment.

An embodiment of an image forming apparatus according to the present invention will hereinafter be described with reference to the accompanying drawings. FIG. 12 shows the general construction of the image forming apparatus according to the present embodiment.

General Construction of the Image Forming Apparatus

The general construction of the image forming apparatus will first be described with reference to FIG. 12. A laser beam printer P forms an image on a recording medium 4 (such as recording paper, an OHP sheet or cloth) by an electrophotographic image forming process.

The surface of a photosensitive drum 10 which is a drum-shaped electrophotographic photosensitive member as an image bearing member is uniformly charged by charging means 11. A laser beam L containing image information is applied from optical means 1 to the photosensitive drum 10 to thereby form an electrostatic latent image conforming to the image information on the photosensitive drum 10. The thus formed electrostatic latent image on the photosensitive drum 10 is developed by developing means which will be described later to thereby form a toner image.

On the other hand, in synchronism with the formation of the toner image, the recording medium 4 set on a feed cassette 6*a* is conveyed and surface-reversed (turned-over) by a pickup roller 6*b*, a conveying guide 6*c* and a pair of registration rollers 6*e*. The recording medium 4 then passes through a nip portion formed by the photosensitive drum 10 and a transferring roller 3 to which a constant voltage is applied. At this time, the toner image developed on the photosensitive drum 10 is transferred to the recording medium 4. The recording medium 4 which has been subjected to the transfer of the toner image is conveyed to fixing means 5 by a conveying guide 6*f*. The fixing means 5 has a driving roller 5*c* and a fixing roller 5*b* having a heater 5*a* therein, and applies heat and pressure to the recording medium 4 as the recording medium 4 passes through the nip portion of the fixing means S, thereby fixing the transferred toner image. Thereafter, the recording medium 4 is conveyed by a pair of delivery rollers 6*i* and is delivered to a delivery tray 7.

Process Cartridge

Figure 1:
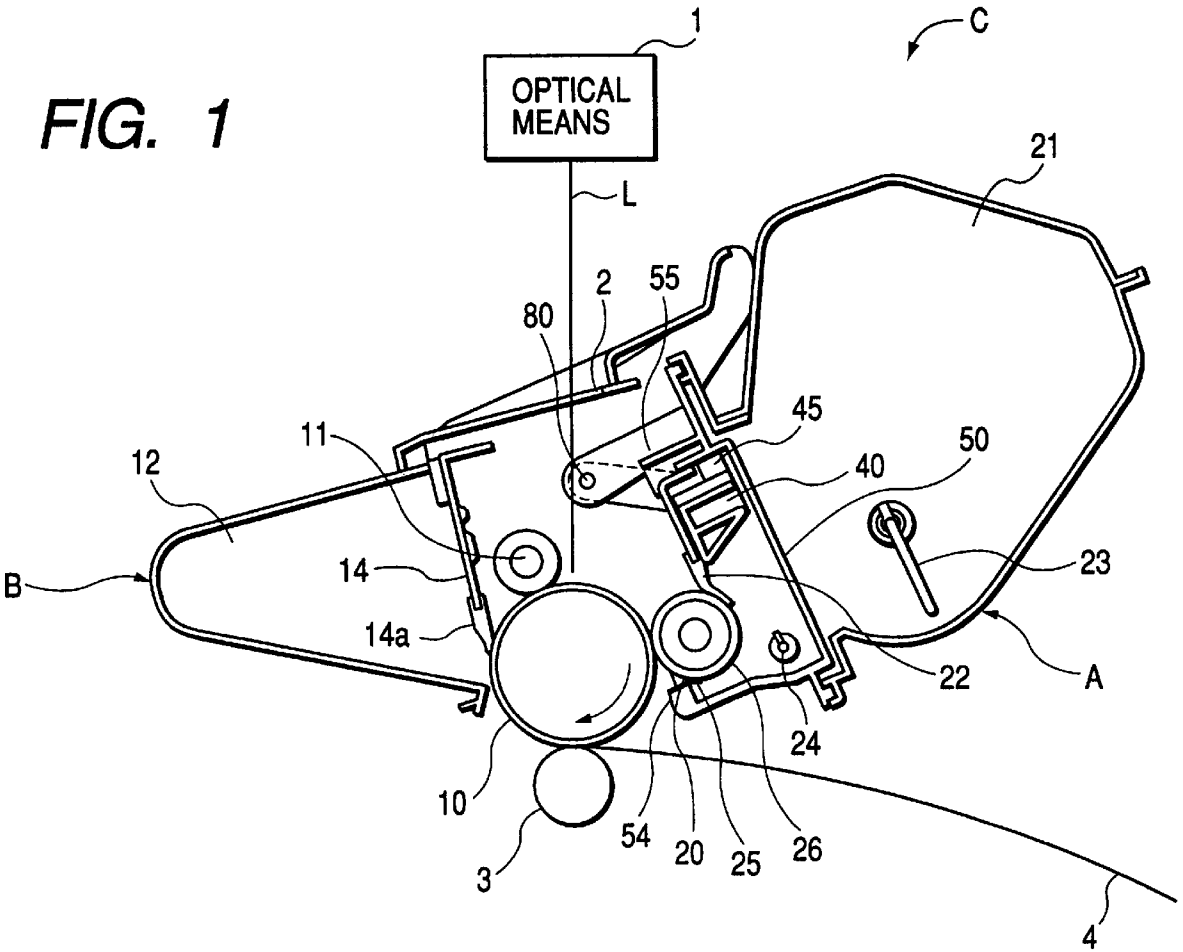
FIG. 1 is a cross-sectional view illustrating a process cartridge.

A process cartridge C will now be described. The process cartridge C is detachably and mountably supported by a supporting means (not shown) of the image forming apparatus as shown in FIG. 12. As shown in FIG. 1, in a photosensitive member unit B of the process cartridge C, there are disposed the photosensitive drum 10 for forming an electrostatic latent image thereon, the charging means 11 for uniformly charging the surface of a photoconductive layer of the photosensitive drum 10, and cleaning means 14 for scraping off from the surface of the photosensitive drum 10 any residual toner not transferred to the recording medium 4 but adhering on the photosensitive drum 10, and storing the scraped-off toner in a waste toner container 12.

Also, in a developing unit A, there are disposed a toner container 21 containing toner therein, a developing roller 20 for supplying the toner to the electrostatic latent image formed on the photosensitive drum 10 to thereby form a visible image, and a developing blade 22 for giving triboelectrification charges to the toner to thereby form a toner layer on the surface of the developing roller 20. Also, in lower openings between the developing roller 20 and a first frame 40 and between the developing roller 20 and a second frame 50, there are provided jet preventing seals 25 for sealing the lower openings, and these seals 25 have the function of preventing the leakage of the toner in the radial direction of the developing roller 20.

Figure 13:
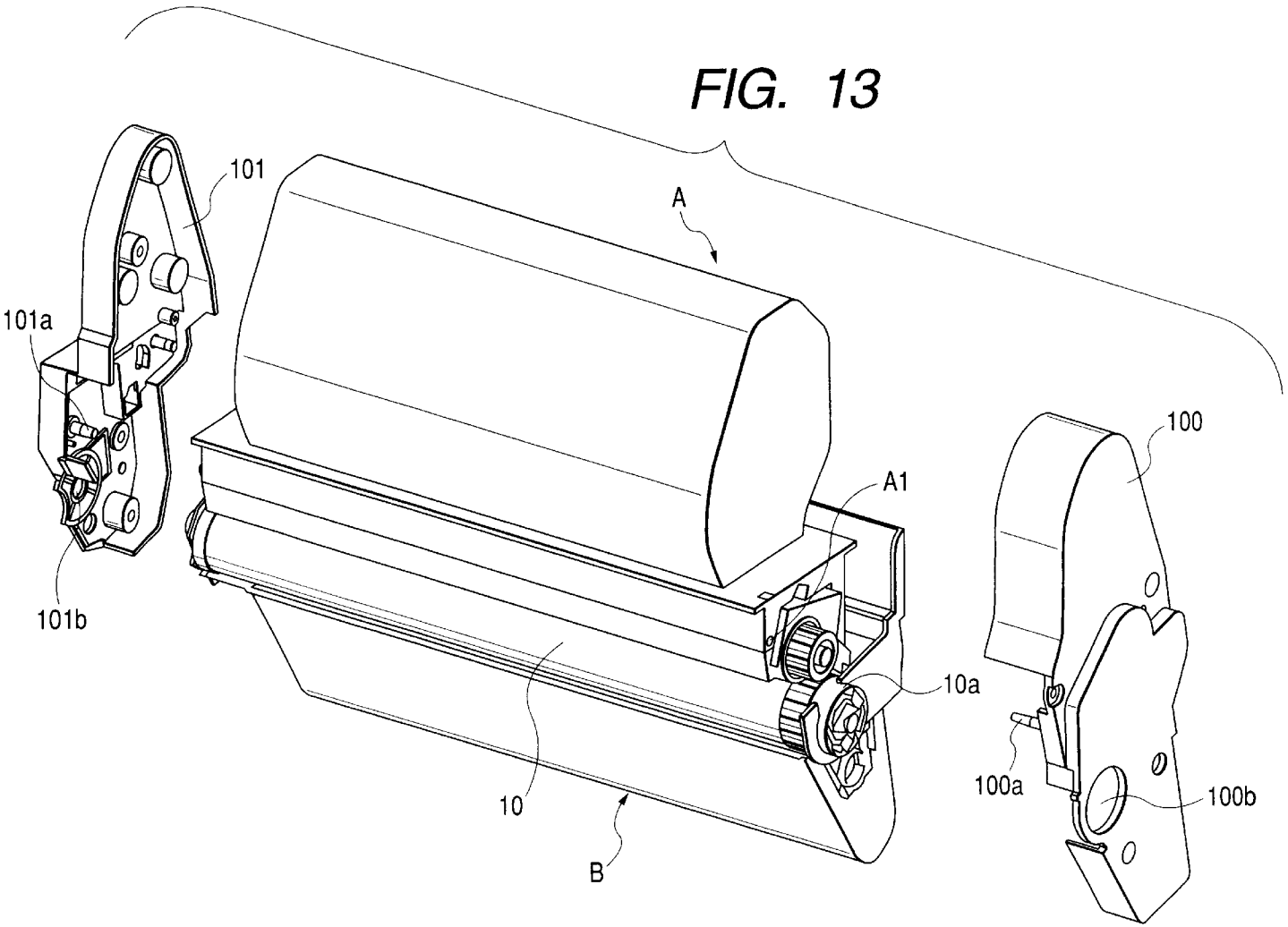
FIG. 13 is a perspective view illustrating the construction of a process cartridge.

The developing unit A and the photosensitive member unit B, as shown in FIG. 13, have their lengthwisely opposite sides integrally connected together and fixed by a side cover 100 and a side cover 101. Thus, they constitute the process cartridge C. The side cover 100 is provided with a pin 100*a* for positioning with respect to the developing unit A, and an aperture 100*b* for positioning with respect to the photosensitive member unit B, and the pin 100*a* and the aperture 100*b* are fitted to a positioning hole Al formed in the developing unit A and a photosensitive drum bearing 10*a* of the photosensitive member unit B, respectively. Thereby, the relative position of the developing unit A and the photosensitive member unit B is determined. Likewise, the side cover 101 is provided with a pin 101*a* for positioning with respect to the developing unit A, and an aperture 101*b* for positioning with respect to the photosensitive member unit B. The pin 101*a* and the aperture 101*b* are fitted to a positioning hole (not shown) formed in the developing unit A and the photosensitive drum bearing (not shown) of the photosensitive member unit B, whereby the two units are positioned and connected together.

In FIG. 1, the photosensitive drum 10 is rotated clockwise. The charging means 11 has a constant voltage applied thereto, and the charging means 11 and the photosensitive drum 10 contact each other and the surface of the photoconductive layer of the photosensitive drum 10 is uniformly charged. Then, the laser beam L conforming to the image information from the optical means 1 is applied to the photosensitive drum 10 through an exposure opening portion 2 to thereby form an electrostatic latent image on the photosensitive drum 10. Thereafter, a toner image is formed on the photosensitive drum 10 by the developing means.

The developing means feeds the toner in the toner container 21 to the developing roller 20 by the rotation of a toner feeding member 23. The developing roller 20 having a stationary magnet therein is rotated and also, a toner layer, having had triboelectrification charges given thereto by the developing blade 22, is formed on the surface of the developing roller 20. The developing roller 20 is urged against the photosensitive drum 10 by a biasing spring 32 (see FIGS. 4 and 10) while keeping a constant clearance through spacer runners 26. The toner layer formed on the surface of the developing roller 20 is supplied to the developing area of the photosensitive drum 10. The toner is shifted to the photosensitive drum 10 in accordance with the electrostatic latent image thereon to thereby form a toner image. The developing blade 22 regulates the amount of toner on the peripheral surface of the developing roller 20 and gives triboelectrification charges. Also, in the vicinity of the developing roller 20, there is rotatably attached a toner agitating member 24 for circulating the toner in a developing chamber.

A voltage opposite in polarity to the toner image is applied to the transferring roller 3 provided in the main body of the image forming apparatus to thereby transfer the toner image formed on the photosensitive drum 10 to the recording medium 4. Thereafter, any residual toner on the photosensitive drum 10 is removed by the cleaning means 14. The cleaning means 14 scrapes off the toner residual on the photosensitive drum 10 by an elastic cleaning blade 14a provided in contact with the photosensitive drum 10 and collects the scraped-off toner into the waste toner container 12.

Figure 2:
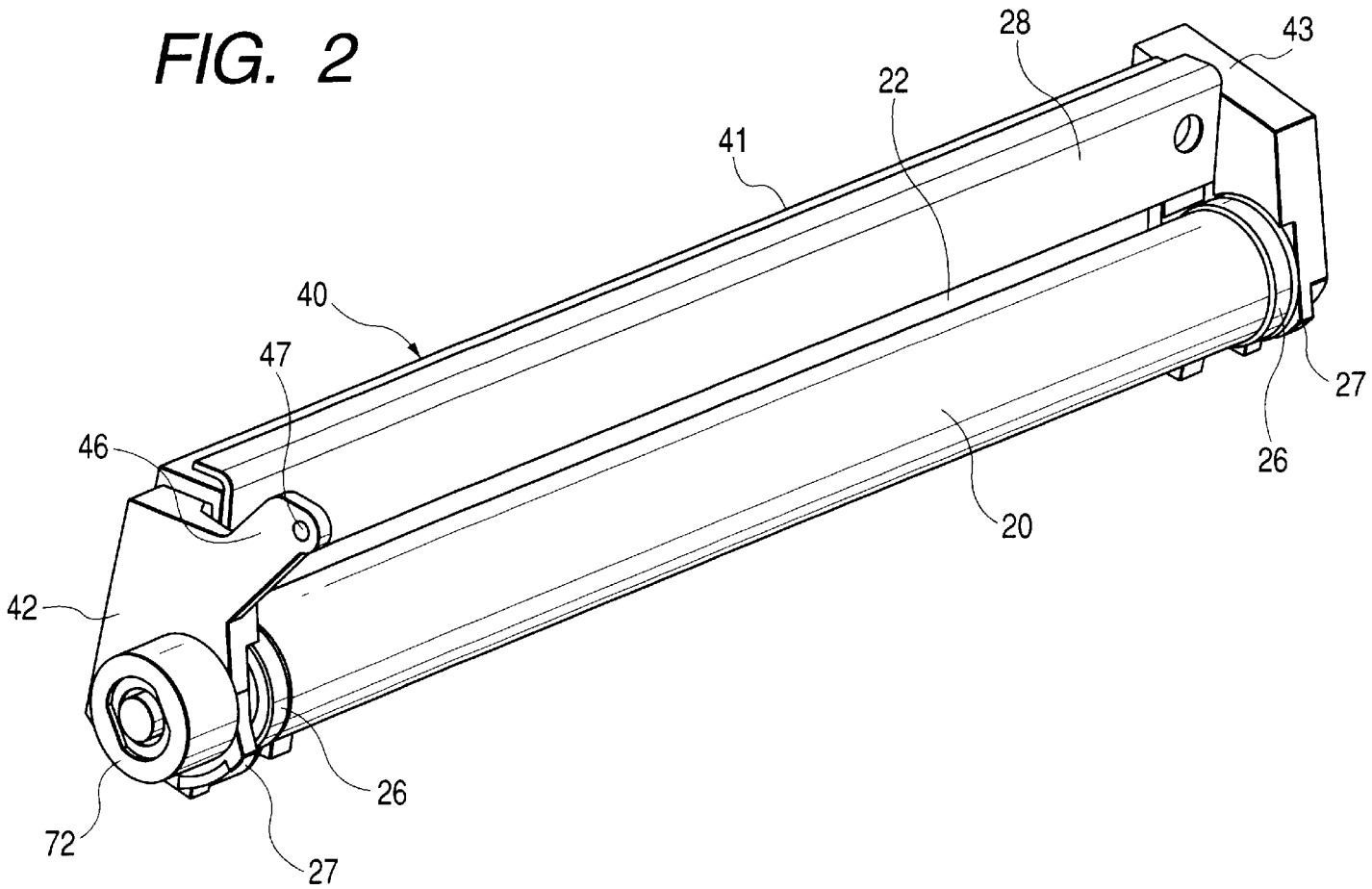
FIG. 2 is a perspective view illustrating a first frame.
Figure 3:
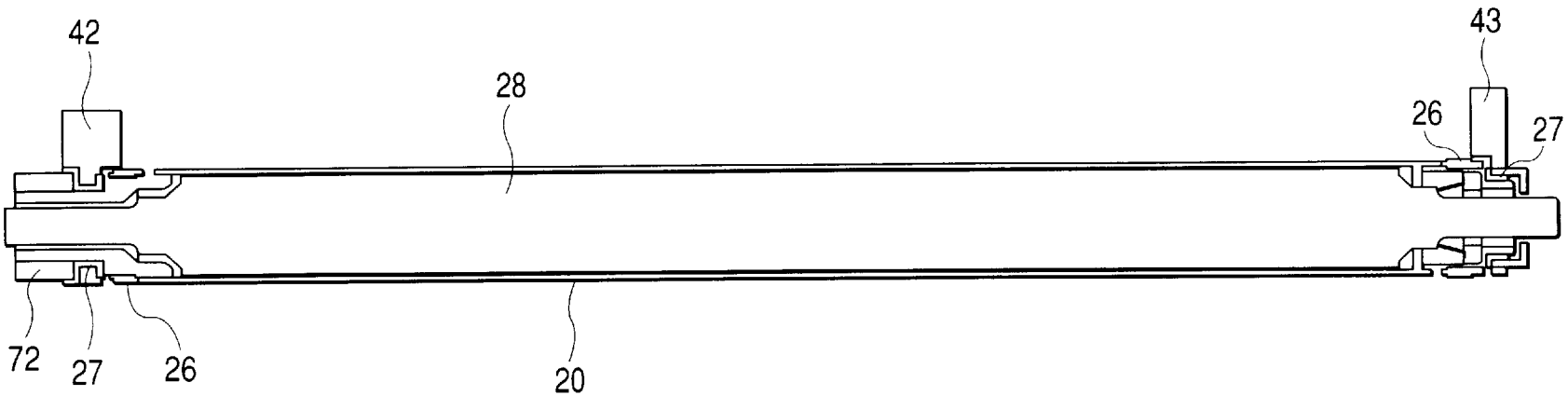
FIG. 3 is a cross-sectional view illustrating the first frame.

As shown in FIG. 1, the developing unit A is comprised of the first frame 40 and the second frame 50. As shown in FIGS. 2 and 3, the first frame 40 is comprised of a movably supported frame (hereinafter referred to as the movable frame) 41, a rockably supported frame (hereinafter referred to as the rockable frame) 42 and a slidably supported frame (hereinafter referred to as the slide frame) 43, disposed at the opposite ends thereof, and the first frame 40 is generally supported for movement relative to the second frame 50. Also, the first frame 40 holds the developing roller 20 and the developing blade 22. The developing roller 20 has its opposite ends rotatably supported by the rockable frames 42 and the slide frames 43 through bearings 27. Also, the spacer runners 26 substantially concentric with the developing roller 20 and having an outer diameter larger by a predetermined gap than the outer diameter of the developing roller 20 are slidably provided at the opposite ends of the developing roller 20. The developing blade 22 as regulating means for regulating the amount of toner on the developing roller 20 is formed integrally with or adhesively secured to a developing blade metal plate 28. The developing blade metal plate 28 is fixed to the movable frame 41, and the distal end of the developing blade 22 abuts against the developing roller 20.

Figure 4:
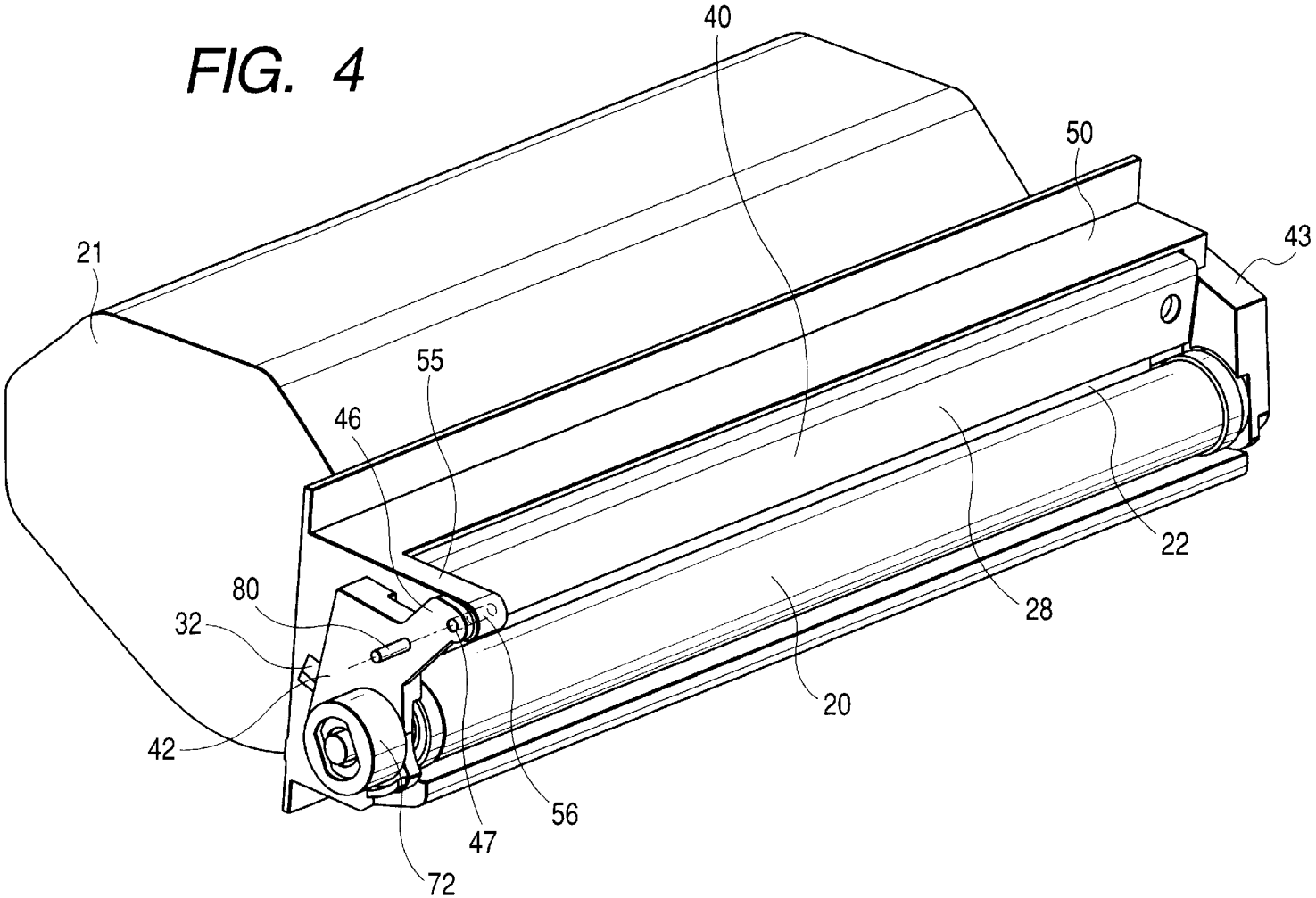
FIG. 4 is a perspective view illustrating the process cartridge.

As shown in FIG. 4, the first frame 40 is installed in the second frame 50.

The second frame 50 is fixed to the toner container 21. The rockable frame 42 of the first frame 40 is provided with a rockable arm 46 having a rocking hole 47 in the end portion thereof, and the second frame 50 is provided with a supporting arm 55 having a fixing hole 56 in the end portion thereof, and the rockable frame 42 and the second frame 50 are rockably engaged with each other by an engagement pin 80. The rocking hole 47 of the rockable frame 42 and the engagement pin 80 are slidable relative to each other, and the fixing hole 56 of the second frame 50 and the engagement pin 80 are force-fitted to each other. The biasing springs 32 are provided between the first frame 40 and the second frame 50. (Specifically, the biasing springs (see FIGS. 4 and 10, the biasing spring on the spring receiving portion 51*f* side being not shown) are attached to spring receiving portions 51*e* and 51*f* of the second frame 50.) The developing roller 20 provided in the first frame 40 is urged against the photosensitive drum 10 with a constant clearance by the spacer runners 26. By the biasing springs 32 being thus disposed, the developing device can be made compact. While in the present embodiment, the second frame 50 is fixed to the toner container 21, the second frame 50 may be formed integrally with the toner container 21 (by integral molding).

Figure 5B:
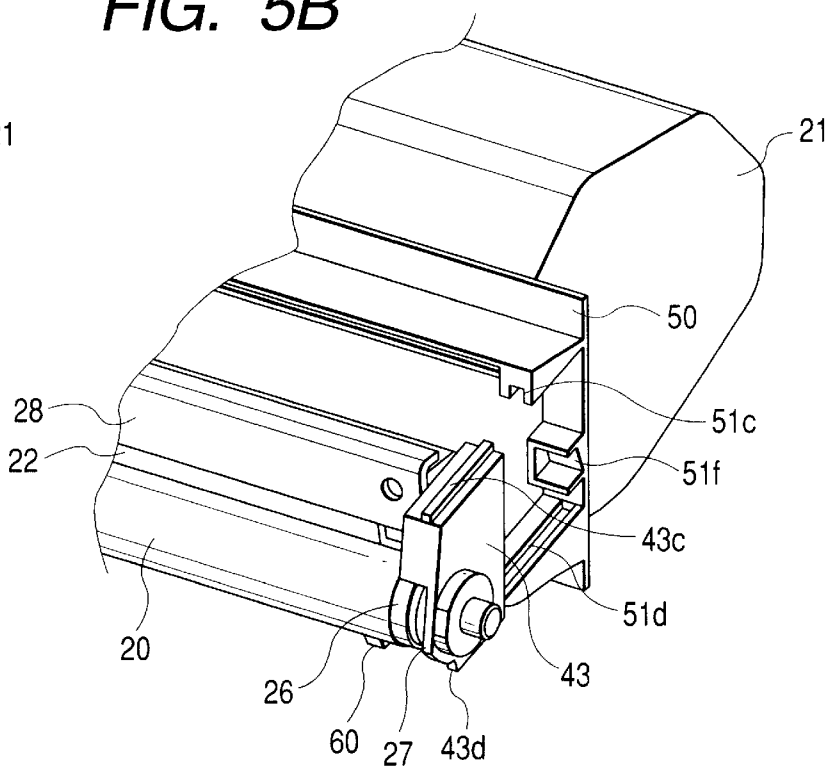
FIG. 5B is an enlarged view of essential portions illustrating a slide frame.
Figure 5A:
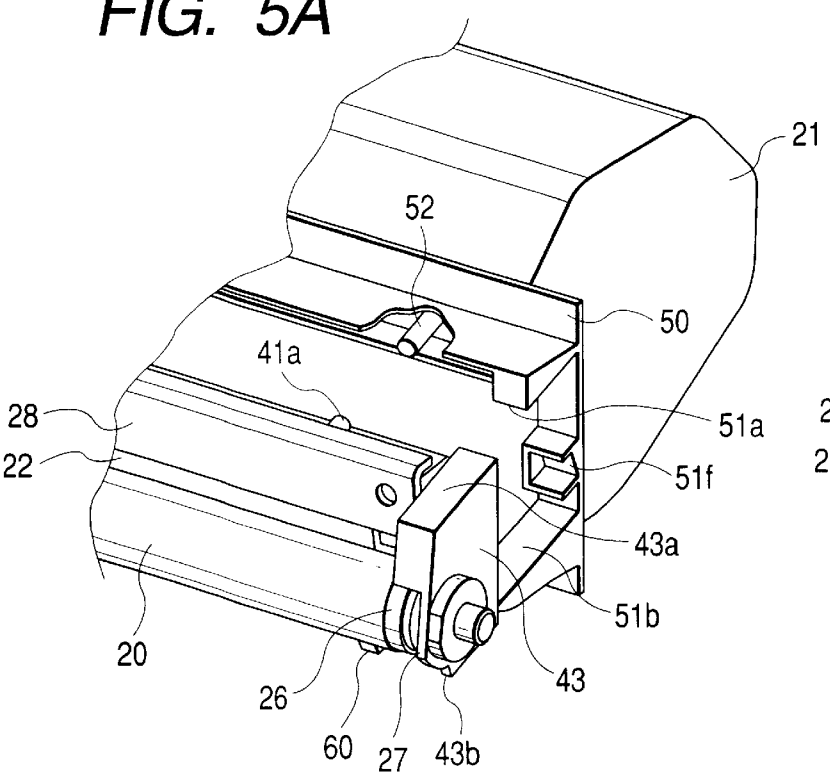
FIG. 5A is an enlarged view of essential portions illustrating a slide frame.

As shown in FIG. 5A, slide flat surfaces 43*a* and 43*b* for determining the slide direction are provided on the substantially upper and lower surfaces of the slide frame 43 parallel to each other. On the other hand, guide flat surfaces 51*a* and 51*b* are provided at regions opposed to the slide flat surfaces 43*a* and 43*b* of the slide frame 43, with a minute clearance provided therebetween, when the first frame 40 is installed in the second frame 50. Further, in order to effect the lengthwise positioning of the second frame 50 and the first frame 40, a positioning boss 52 is provided on the second frame 50, and a positioning slot 41*a* for determining only the lengthwise direction is formed in the movable frame 41. The slide frame 43 can be slid in a predetermined direction by the slide flat surfaces 43*a*, 43*b* and the guide flat surfaces 51*a*, 51*b*. As an alternative construction, as shown in FIG. 5B, slide rail convex portions 43*c* and 43*d* for determining the slide direction are provided on the substantially upper and lower surfaces of the slide frame 43, and slide rail concave portions 51*c* and 51*d* are provided at the opposed regions of the second frame 50. The rail fitting portion of the slide frame 43 may be made of a construction for positioning the lengthwise direction of the slide frame 43 and the second frame 50.

Figure 6:
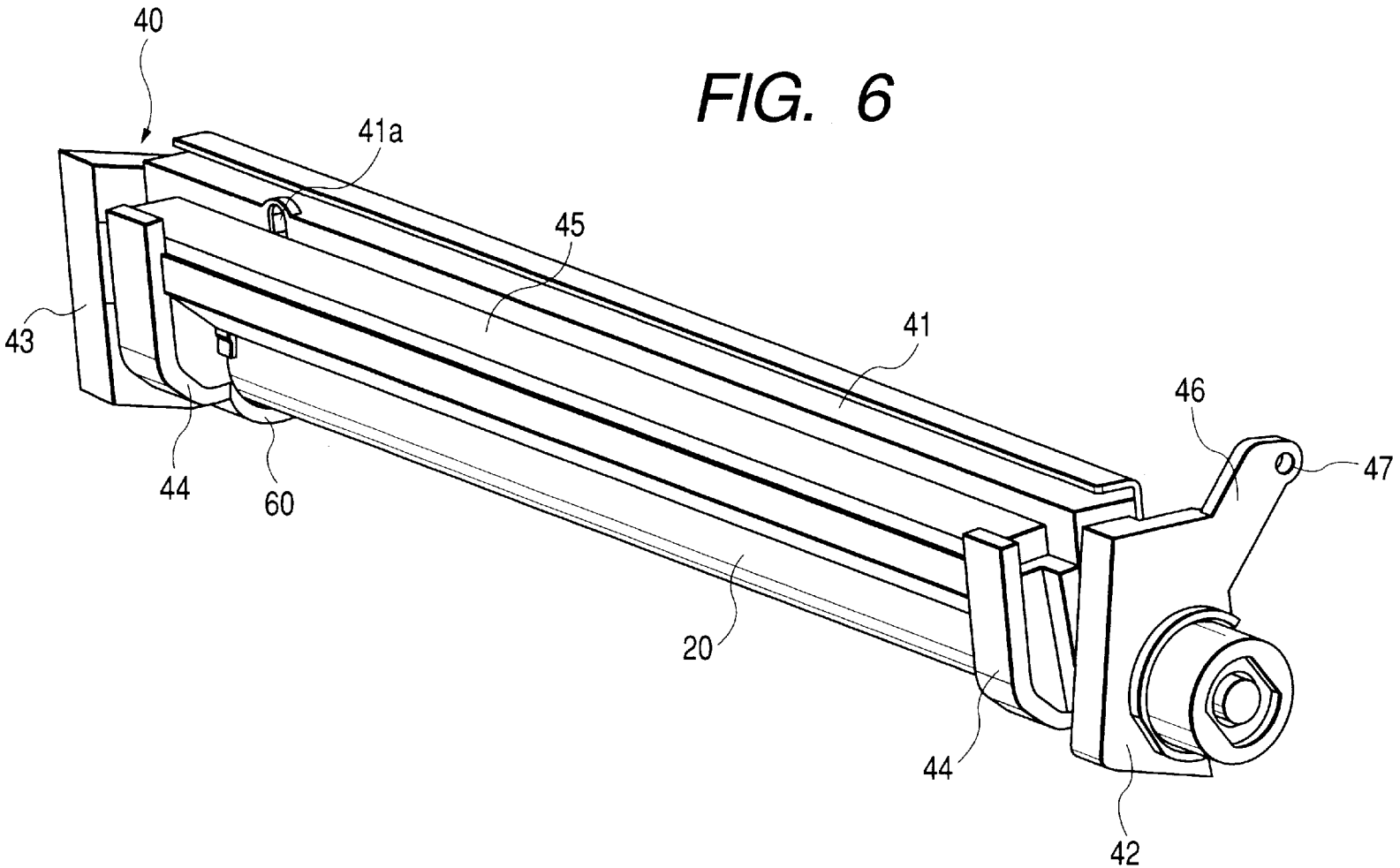
FIG. 6 is a view of the first frame illustrating a toner seal construction.
Figure 7:
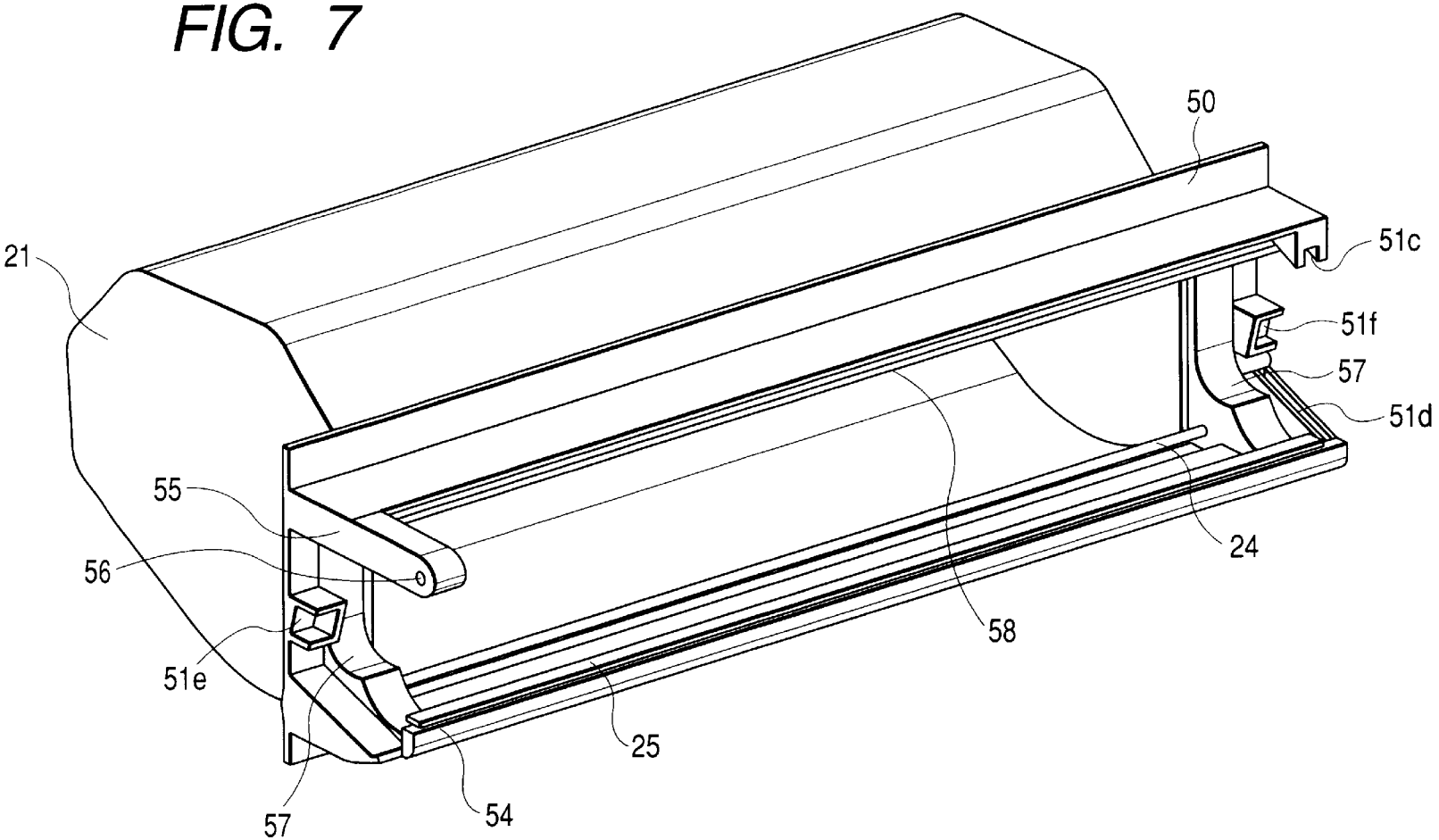
FIG. 7 is a view of a second frame illustrating the toner seal construction.
Figure 8:
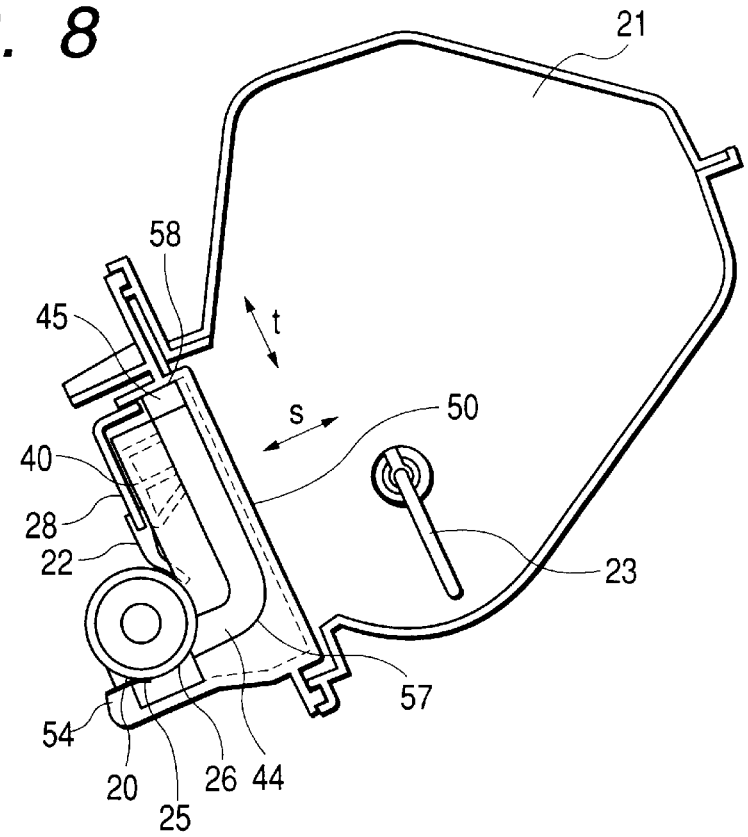
FIG. 8 is a cross-sectional view illustrating the direction of compression of the toner seal.

FIG. 6 shows a toner seal construction for the first frame 40 and the second frame 50. Elastic seal members 44 and an elastic seal member 45 are fixed to the shorter side portions at the opposite ends and the upper longer side portion, respectively, of the first frame 40 by adhesive-double-coated-tapes, and are compressed by the receiving surfaces 57 and 58 of the second frame 50 shown in FIG. 7 to thereby provide the sealing effect of preventing the leakage of the toner. In FIG. 8, the double-headed arrows "s" and "t" indicate the directions of compression of the elastic seal members 44 on the shorter side portions at the opposite ends and the elastic seal member 45 on the upper longer side portion, respectively. Here, the direction of compression of the elastic seal member 45 is set so as to be a direction substantially perpendicular to the direction of movement of the first frame 40. By doing so, it is possible to decrease the influence of the repulsive force of the elastic seal member 45, which is larger in a compression area, upon the pressure force with which the developing roller 20 is urged against the photosensitive drum 10 and stabilize the pressure force.

Also, a jet preventing sheet 25 is fixed to the lower longer side portion 54 of the second frame 50 by an adhesive-double-coated tape so as to abut against the developing roller 20 and prevents the leakage of the toner in the radial direction of the lower portion of the developing roller 20. By doing this, it is unnecessary to adopt a construction in which an elastic seal member is disposed on the lengthwise lower surface of the first frame 40, and it is possible to realize the compactness of the apparatus.

Figure 9:
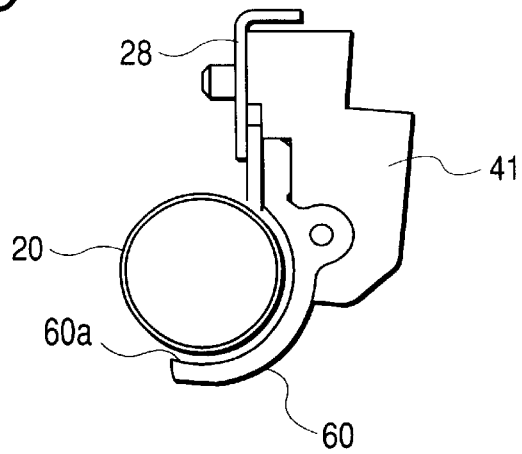
FIG. 9 illustrates the construction of the toner seals on the opposite end portions of a developing roller.

FIG. 9 shows toner seals on the opposite end portions of the developing roller 20. A magnetic seal 60 is provided with a plurality of magnetic poles on the surface 60*a* thereof opposed to the surface of the developing roller 20, and is sealing means for adsorbing the toner by the magnetic curtain between itself and the developing roller 20. The magnetic seal 60 is inserted and positioned in a recess (not shown) formed in the movable frame 41, and is urged and fixed by the developing blade metal plate 28. The developing roller 20 and the magnetic seal 60 are fixed to the same first frame 40. Consequently, even if the developing roller follows the outer periphery of the photosensitive drum 10 and the first frame 40 moves, the clearance between the developing roller 20 and the magnetic seal 60 can be accurately set constantly. Therefore, the toner sealing of the opposite end portions of the developing roller 20 by the magnetic seal 60 can be done well.

Figure 10:
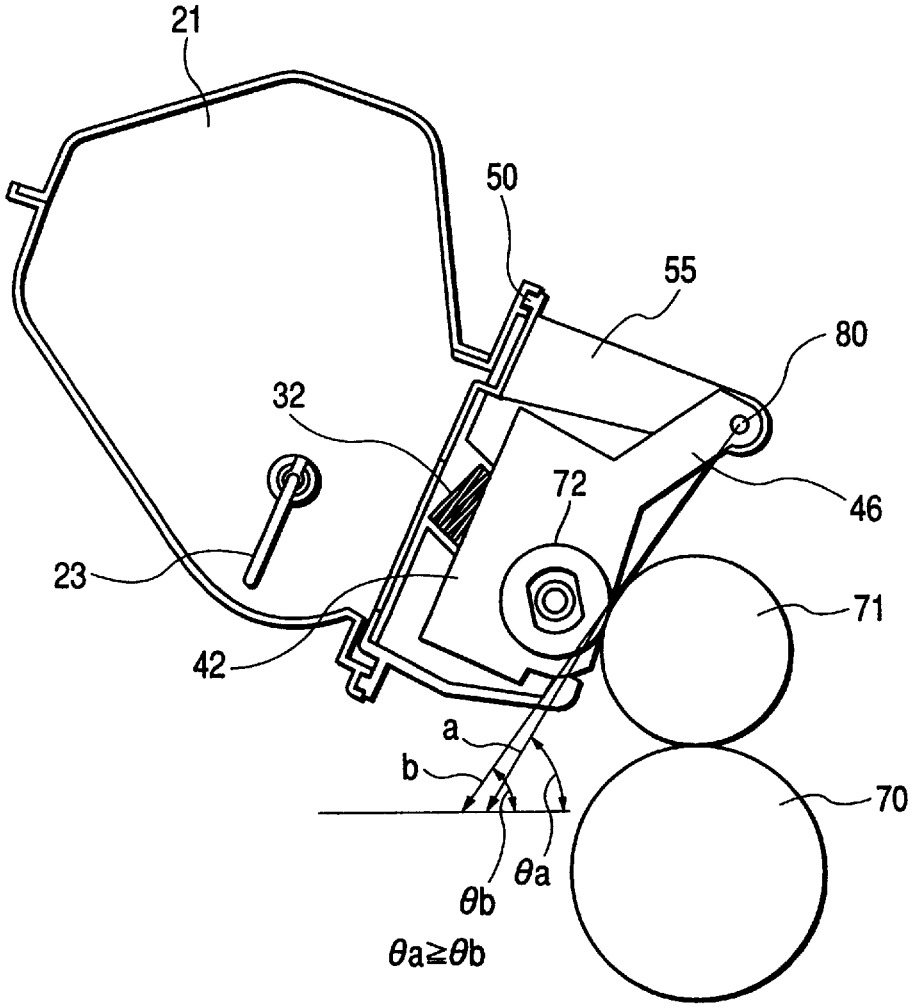
FIG. 10 is a schematic view of a driving system for the developing roller.

FIG. 10 is a schematic view of a driving system for the developing roller 20 in the present embodiment. A drum gear 71 provided at an end portion of the photosensitive drum 10 has a driving force transmitted thereto from the image forming apparatus (not shown) through a driving gear 70, and rotatably drives the photosensitive drum 10. On the other hand, the drum gear 71 rotatably drives a developing roller gear 72 provided coaxially with the developing roller 20. In FIG. 10, the arrow "a" indicates the direction of an acting force acting on the developing roller gear 72 when the drive is transmitted from the drum gear 71 to the developing roller gear 72. The arrow "b" in FIG. 10 is a line linking the center of the rocking movement of the rockable frame 42 and the acting point (the meshing point on a pitch circle) of the acting force acting on the developing roller gear 72 together. When the angle formed by the arrow "a" with the horizontal line is defined as $\theta a$ and the angle formed by the arrow "b" with the horizontal line is defined as $\theta b$, the following relation is established therebetween: $\theta a \geqq \theta b$. As a result, the acting force acting on the developing roller gear 72 acts in a direction to urge the developing roller 20 against the photosensitive drum 10. Therefore, the pressure between the developing roller 20 and the photosensitive drum 10 is not decreased under the influence of the acting force, and the spacer runners 26 are not spaced apart from the photosensitive drum 10 by the action of a slight extraneous force.

As described above, the design is made such that driving is effected on the rockable frame side, whereby an increase in a frictional resistance force on the slide surface, created by the influence of a force acting during the transmission of a driving force when sliding movement is adopted, can be avoided. Also, on the slide side at the other end, such parts as a member constituting a rocking shaft and a rockable arm can be curtailed and therefore, there can be provided a compact and low-cost developing device.

Figure 11:
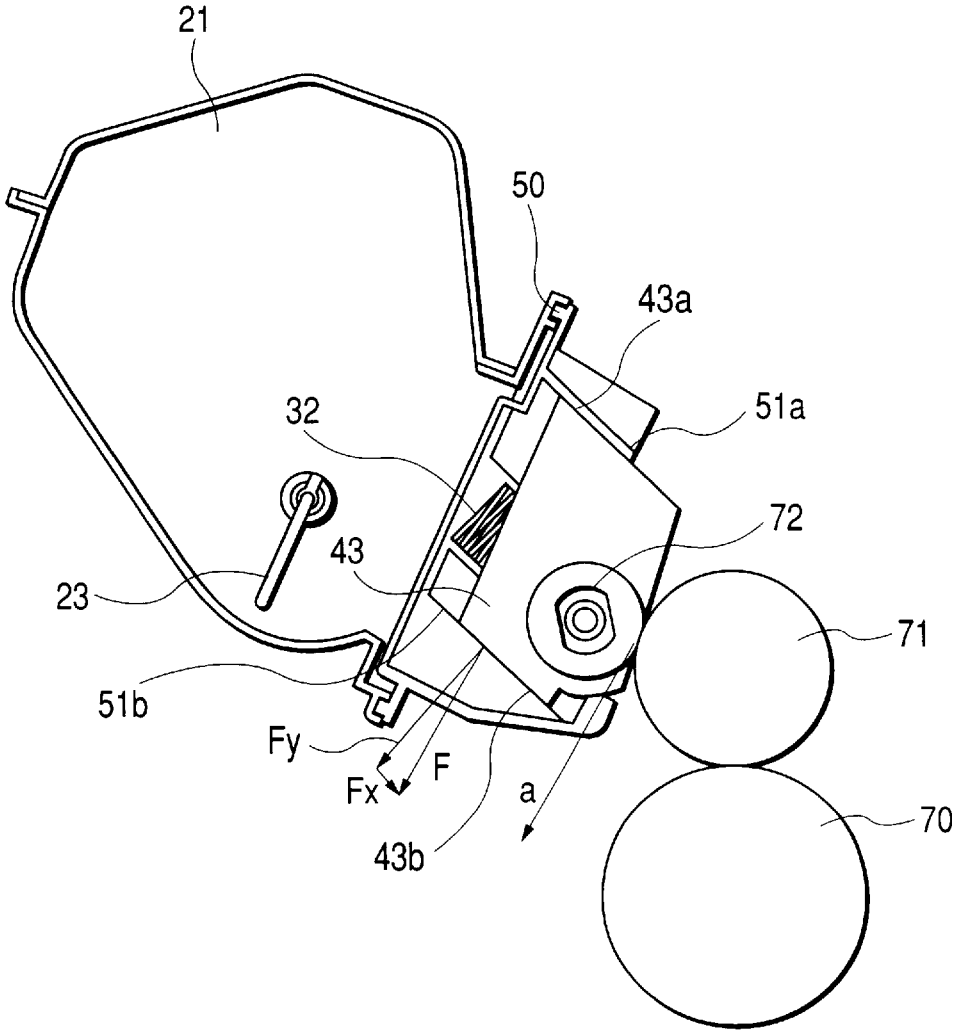
FIG. 11 shows the construction in which the developing roller is driven on the slide frame side.

FIG. 11 shows a construction which is another embodiment in which the developing roller 20 is driven on the slide frame side. In this construction, the developing roller gear 72 is disposed on the slide frame side. In FIG. 1, the arrow "a" indicates the direction of an acting force acting on the developing roller gear 72 when a driving force is transmitted from the drum gear 71 to the developing roller gear 72. The angle of the slide flat surfaces 43*a* and 43*b* of the slide frame 43 may be a right angle with respect to the arrow "a", or may be set to an angle at which, when an acting force acts on the slide flat surfaces 43*a* and 43*b*, the force urges the first frame 40 toward the photosensitive drum 10. In FIG. 11, the reference letter "F" designates a force created by the acting force acting on the developing roller gear 72. The reference letters "Fy" denote a component force in a direction perpendicular to the guide flat surface 51*b* for the force F, and the reference letters "Fx" designate a component force in a direction parallel to the guide flat surface 51*b* for the force F. The component force Fx is directed to the photosensitive drum 10. By doing this, under the influence of the acting force from the gear 72 when the developing roller 20 is driven, the pressure between the developing roller 20 and the photosensitive drum 10 is not decreased and the spacer runners 26 are not spaced apart from the photosensitive drum 10 by the action of a slight extraneous force.

Also, in the present embodiment, as previously described, the first frame 40 has one end thereof in the lengthwise direction (the axial direction of the developing roller 20) supported for rotation relative to the second frame 50 and the other end thereof in the lengthwise direction slidably supported. However, as another embodiment, both ends in the lengthwise direction may be rotatably supported or both ends in the lengthwise direction may be slidably supported.

Also, in the present embodiment, as previously described, the developing unit A is a unit having the first frame 40 for supporting the developing roller 20, the second frame 50 for movably supporting the first frame 40, and supporting the toner container 21, and the biasing spring 32. Also, the photosensitive member unit B has the photosensitive drum 10, the charging means 11, the waste toner container 12 and the cleaning means 14. Consequently, the connecting and assembly of the developing unit A movably supported by the first frame 40 and the photosensitive member unit B can be done easily.

As described above, the effect of the present invention is to provide the capability of stabilizing the pressure force of the developing roller 20 toward the photosensitive drum or the image bearing member 10. Particularly, it has become possible to stabilize the pressure force of the developing roller 20 toward the image bearing member 10 independently of the amount of developer in the developer containing portion.

Also, the developing unit A has the developing roller 20 for developing the electrostatic latent image formed on the image bearing member10, the developer containing portion for containing therein the developer to be supplied to the developing roller 20, the first frame 40 for supporting the developing roller 20, the second frame 50 for movably supporting the first frame 40, and supporting the developer containing portion, and the biasing spring or urging member 32 for urging the developing roller 20 toward the image bearing drum member 10, whereby the pressure force of the developing roller toward the image bearing member 10 can be stabilized and at the same time, the assembling property of the process cartridge C can be improved.

While the invention has been described with reference to the structure disclosed herein, it is not confined to the details set forth and this application is intended to cover such modifications or changes as may come within the purposes of the improvements or the scope of the following claims.

What is claimed is:

1. A developing device comprising:

a developing roller configured and positioned to develop an electrostatic latent image formed on an image bearing member;

a developer containing portion configured and positioned to contain developer to be supplied to said developing roller;

a first frame configured and positioned to support said developing roller;

a second frame configured and positioned to movably support said first frame, and supporting said developer containing portion; and an urging member configured and positioned to urge said developing roller toward the image bearing member.

2. A developing device according to claim 1, wherein said urging member is provided between said first frame and said second frame.

3. A developing device according to claim 1, wherein said first frame is supported for rotation relative to said second frame.

4. A developing device according to claim 1, wherein said first frame is supported for sliding movement relative to said second frame.

5. A developing device according to claim 1, wherein said first frame has one end thereof in an axial direction of said developing roller rotatably supported and the other end thereof in said axial direction slidably supported, relative to said second frame.

6. A developing device according to claim 1, wherein said developer containing portion is fixed to said second frame.

7. A developing device according to claim 1, wherein said developer roller is provided with a spacer for keeping the spacing between said developing roller and the image bearing member constant.

8. A developing device according to claim 1, wherein said first frame is provided with a regulating member configured and positioned to regulate the amount of the developer on said developing roller.

9. A process cartridge detachably mountable to a main body of an electrophotographic image forming apparatus, said process cartridge comprising:

an image bearing member; and a developing unit having a developing roller configured and positioned to develop an electrostatic latent image formed on said image bearing member, a developer containing portion configured and positioned to contain developer to be supplied to said developing roller, a first frame configured and positioned to support said developing roller, a second frame configured and positioned to movably support said first frame, and supporting said developer containing portion, and an urging member configured and positioned to urge said developing roller toward said image bearing member.

10. A process cartridge according to claim 9, wherein said urging member is provided between said first frame and said second frame.

11. A process cartridge according to claim 9, wherein said first frame is supported for rotation relative to said second frame.

12. A process cartridge according to claim 9, wherein said first frame is supported for sliding movement relative to said second frame.

13. A process cartridge according to claim 9, wherein said first frame has one end thereof in an axial direction of said developing roller rotatably supported and has the other end thereof in said axial direction slidably supported, relative to said second frame.

14. A process cartridge according to claim 9, wherein said developer containing portion is fixed to said second frame.

15. A process cartridge according to claim 9, wherein said developing roller is provided with a spacer for keeping the spacing between said developing roller and said image bearing member constant.

16. A process cartridge according to claim 9, wherein said first frame is provided with a regulating member configured and positioned to regulate the amount of the developer on said developing roller.

17. A process cartridge according to claim 9, further comprising:

charging means for charging a surface of said image bearing member; and cleaning means for removing residual toner remaining on the surface of said image bearing member, and storing the removed residual toner.

18. A process cartridge according to claim 9, wherein said process cartridge is constituted by connecting an image bearing member unit supporting said image bearing member with said developing unit.

19. An image forming apparatus to which a process cartridge is detachably mounted for forming an image on a recording medium, said image forming apparatus comprising:

(i) said process cartridge having an image bearing member and a developing unit, said developing unit having a developing roller configured and positioned to develop an electrostatic latent image formed on said image bearing member, a developer containing portion configured and positioned to contain a developer to be supplied to said developing roller, a first frame configured and positioned to support said developing roller, a second frame configured and positioned to movably support said first frame, and supporting said developer containing portion, and an urging member configured and positioned to urge said developing roller toward said image bearing member;

(ii) supporting means for detachably and mountably supporting said process cartridge; and (iii) conveying means for conveying the recording medium to said image bearing member.

20. An electrophotographic image forming apparatus to which a process cartridge is detachably mountable for forming an image on a recording medium, said electrophotographic image forming apparatus comprising:

(i) supporting means for detachably mounting the process cartridge, the process cartridge having an image bearing member and a developing unit, the developing unit having a developing roller configured and positioned to develop an electrostatic latent image formed on the image bearing member, a developer containing portion configured and positioned to contain developer to be supplied to the developing roller, a first frame configured and positioned to support the developing roller, a second frame configured and positioned to movably support the first frame, and supporting the developer containing portion, and an urging member configured and positioned to urge the developing roller toward the image bearing member; and (ii) conveying means for conveying the recording medium.

* * * * *

UNITED STATES PATENT AND TRADEMARK OFFICE

CERTIFICATE OF CORRECTION

PATENT NO. : 6,671,477 B2
DATED : December 30, 2003
INVENTOR(S) : Noriyuki Komatsu et al.

It is certified that error appears in the above-identified patent and that said Letters Patent is hereby corrected as shown below:

Column 3,
Line 29, “means S,” should read -- means 5, --.

Signed and Sealed this

Twenty-ninth Day of June, 2004

JON W. DUDAS
*Acting Director of the United States Patent and Trademark Office*